US007901221B1

(12) United States Patent
Li et al.

(10) Patent No.: US 7,901,221 B1
(45) Date of Patent: Mar. 8, 2011

(54) UNIVERSAL SERIAL BUS GROUND CLIP

(75) Inventors: Chris T. Li, Fremont, CA (US); Steven Chase, Cupertino, CA (US)

(73) Assignee: Amazon Technologies, Inc., Reno, NV (US)

( * ) Notice: Subject to any disclaimer, the term of this patent is extended or adjusted under 35 U.S.C. 154(b) by 0 days.

(21) Appl. No.: 12/351,732

(22) Filed: Jan. 9, 2009

(51) Int. Cl.
*H01R 4/66* (2006.01)

(52) U.S. Cl. ..... 439/95; 439/607.28; 439/607.4

(58) Field of Classification Search ..... 439/92, 439/95, 939, 607.2, 607.27, 607.28, 607.35, 439/607.4
See application file for complete search history.

(56) References Cited

U.S. PATENT DOCUMENTS

| | | | | |
|---|---|---|---|---|
| 3,383,457 | A | 5/1968 | Schumacher | |
| 3,549,787 | A | 12/1970 | Churla | |
| 4,637,669 | A * | 1/1987 | Tajima | 439/95 |
| 5,092,795 | A * | 3/1992 | Kitagawa | 439/668 |
| 5,207,597 | A * | 5/1993 | Kline et al. | 439/607.38 |
| 5,397,250 | A * | 3/1995 | Briones | 439/620.17 |
| 5,401,192 | A * | 3/1995 | Briones et al. | 439/639 |
| 5,949,020 | A | 9/1999 | Mitchell et al. | |
| 6,050,854 | A * | 4/2000 | Fang et al. | 439/607.02 |
| 6,132,253 | A * | 10/2000 | Wu | 439/607.19 |
| 6,190,205 | B1 * | 2/2001 | Wu | 439/607.34 |
| 6,319,061 | B1 * | 11/2001 | Chen et al. | 439/607.15 |
| 6,343,941 | B1 * | 2/2002 | Kan | 439/95 |
| 6,343,956 | B2 * | 2/2002 | Stickney | 439/607.17 |
| 6,368,154 | B1 * | 4/2002 | Hirata et al. | 439/607.17 |
| 6,478,622 | B1 * | 11/2002 | Hwang | 439/607.2 |
| 6,482,044 | B1 * | 11/2002 | Ma et al. | 439/668 |
| 6,582,240 | B2 * | 6/2003 | Suto | 439/79 |
| 6,773,275 | B1 * | 8/2004 | Chen | 439/92 |
| 7,044,791 | B2 * | 5/2006 | Wang | 439/607.35 |
| 7,371,084 | B2 * | 5/2008 | Xue et al. | 439/95 |
| 7,473,127 | B2 * | 1/2009 | Wang et al. | 439/541.5 |
| 7,530,845 | B1 * | 5/2009 | Yang | 439/607.01 |
| 7,608,782 | B2 | 10/2009 | Hill | |
| 7,686,646 | B2 * | 3/2010 | Lee et al. | 439/567 |
| 7,708,600 | B2 * | 5/2010 | Wu | 439/660 |
| 2008/0266198 | A1 | 10/2008 | Walker et al. | |

* cited by examiner

*Primary Examiner* — Neil Abrams
(74) *Attorney, Agent, or Firm* — Lee & Hayes, PLLC

(57) ABSTRACT

Disclosed is a clip configured to ground a receptacle, such as a micro universal serial bus (MUSB) receptacle, to a ground plane. The clip may comprise a pair of locating features extending from the front edge of the clip for alignment with an edge of a circuit board to which the receptacle is affixed, a spring tab on the top surface configured to contact the ground plane when the device is assembled, and engagement features on the left and right sides of the receptacle surface configured to engage the clip to the receptacle.

16 Claims, 6 Drawing Sheets

UNIVERSAL SERIAL BUS GROUND CLIP

BACKGROUND

Universal Serial Bus (USB) connections are in widespread use for enabling communication between electronic devices. As the form factor of these electronic devices shrinks, the connectors associated with USB have shrunk as well. Micro USB (MUSB) connectors are now available.

MUSB connectors, however, can be challenging to install in small form factor devices. Creating an effective electrical ground connection between the MUSB receptacle and a grounding surface, such as an electrically conductive device cover, backplane, printed circuit board, etc., allows the USB connection to operate as designed and reduces the likelihood of device damage due to electrostatic discharge (ESD) or high voltage pulse (HVP).

It can be difficult to achieve ground USB receptacles in small form factor devices with limited interior volume. It is particularly challenging to achieve an effective, reliable and cost effective electrical ground in low profile applications such as, for example, e-book readers, cellular telephones, portable media players, laptops, netbooks, and the like.

Existing electronic devices have used conductive foam to establish a ground. However, the conductive foam cannot be easily repositioned and may not be sufficiently conductive to prevent an ESD or HVP. In existing low profile applications, grounding springs are too large to fit in the available space and/or too flimsy to establish a satisfactory ground against the grounding surface.

Conductive foam and existing grounding springs may also push back excessively during assembly. This push back complicates alignment of parts and increases the force necessary to mate parts together during assembly.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
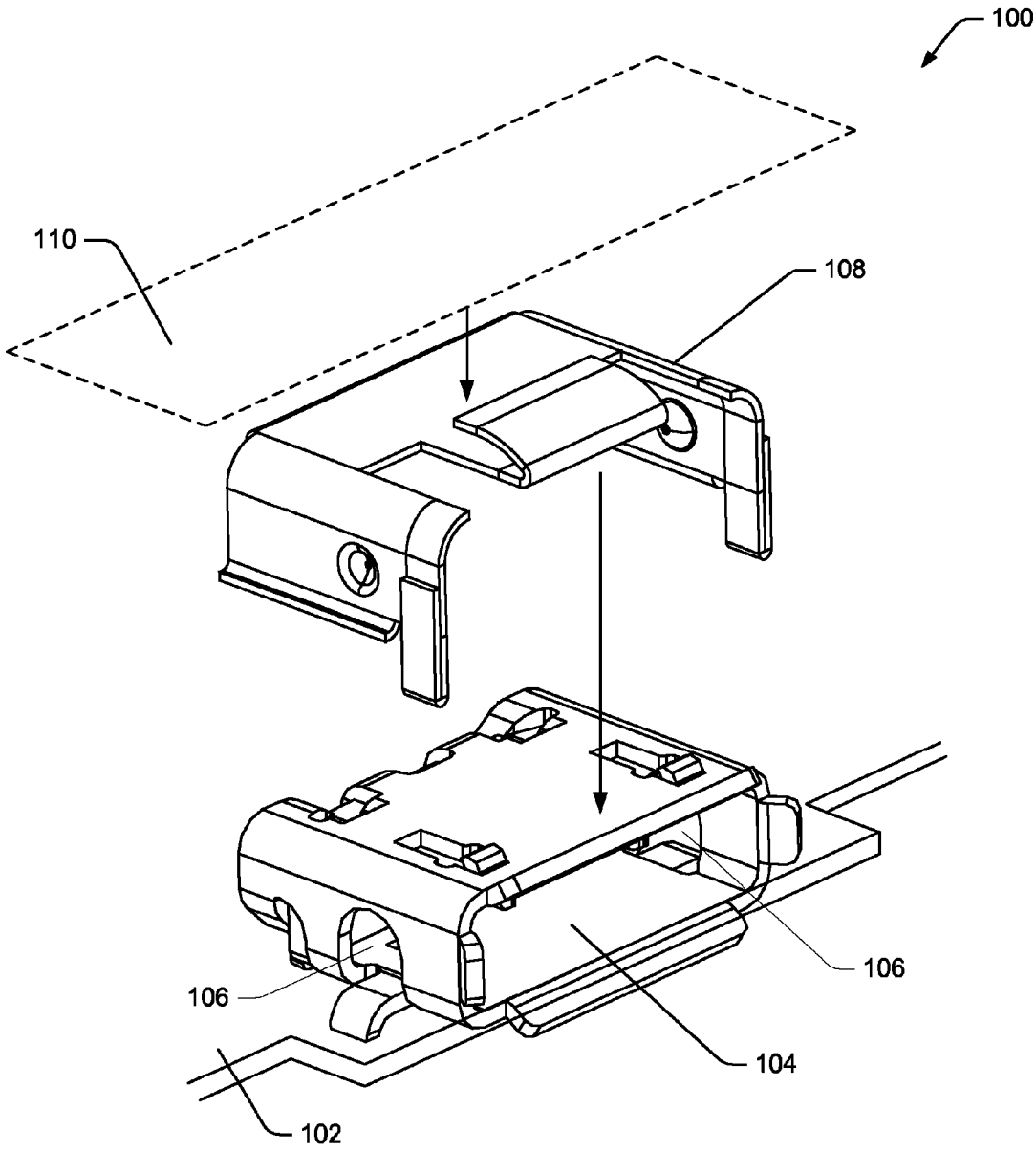
FIG. 1 shows an illustrative Micro Universal Serial Bus (MUSB) grounding system including a grounding clip.

In small form factor devices with limited interior volume and/or low profile applications, such as e-book readers, cellular telephones, portable media players, laptops, netbooks, and the like, achieving an effective, reliable and cost effective electrical ground between a micro Universal Serial Bus (MUSB) receptacle and a grounding surface can be difficult.

This application describes a low profile form-factor grounding clip of conductive material to achieve an effective, reliable, and cost effective electrical ground connection between a MUSB receptacle in an electronic device and the grounding surface. The clip uses an interference fit to produce positive engagement between the MUSB receptacle, and has a spring tab to engage a conductive grounding surface, such as a cover, housing, ground plane, etc. The clip may also have locating features to aid in alignment during assembly.

The clip also facilitates assembly. By positively engaging to the MUSB receptacle, the clip is not loose during assembly. This allows multiple attempts at assembly of the device grounding surface, without risk of dislodging the grounding clip. Thus, the grounding clip assures a reliable electrical ground connection. The profile and placement of the spring tab reduces or eliminates pushback during assembly of the grounding surface towards the MUSB receptacle.

Generally, the MUSB connection utilizes a plug and a complimentary receptacle. For example, an electronic device having a printed circuit board (PCB) may have a receptacle affixed thereto for transmission of data and/or power to or from the device. A cable may connect an external device to the receptacle. This connection to external devices introduces a potential pathway for electrostatic discharge (ESD) or high voltage pulses (HVPs). Grounding the MUSB receptacle provides protection against ESD and HVP events.

In low profile devices, there may be limited space to provide a ground connection to a conductive cover, housing, ground plane, etc., which goes over the receptacle. Existing USB connections make use of conductive foam. However, this makes removal and repositioning of the conductive cover, housing, ground plane, etc., difficult. Furthermore, conductive foam may not provide the level of conductivity required to adequately ground the device. Similarly, existing grounding springs positioned on the grounding cover or affixed to the top of the receptacle have been flimsy, prone to breakage, and may be easily dislocated during assembly, thus failing to produce the desired ground connection.

The grounding clips disclosed herein are designed to fit around a MUSB receptacle. The grounding clips snap onto the receptacle using interference features such as dimples or tabs. On the top of the grounding clip a spring tab extends to make contact with the conductive ground surface above the receptacle. The spring tab may also be located on one of the other sides of the clip, and may extend outward to make contact with an adjacent ground surface, such as the side of a case.

On the front of the grounding clip, locating features or prongs may extend downwards to provide a positive alignment relative to the PCB. The device cover may be installed once the grounding clip is snapped onto the receptacle. This design makes removal or repositioning of the device cover possible, while still producing the desired ground connection upon reassembly.

While the grounding clip is described in the context of a grounding clip for a MUSB receptacle, grounding clips may also be used to ground other types of receptacles, such as standard USB connections, serial port connections, IEEE 1394 connections, and the like.

Grounding Clip Having a Back and Also Front Locating Features

FIG. 1 shows an illustrative MUSB grounding system 100. PCB 102 is shown with a MUSB receptacle 104 affixed. Holes 106 or detents are typically present on both the left and right vertical sides of the receptacle 104.

An illustrative grounding clip 108 placed down onto receptacle 104 is shown. Once placed around receptacle 104, an engagement feature retains the grounding clip 108 on receptacle 104. In one example, this engagement feature may be a dimple on one surface and a hole 106 or detent on the other. A grounding surface 110 above the grounding clip 108 may be brought into contact with a portion of grounding clip 108 to make the ground connection.

Figure 2:
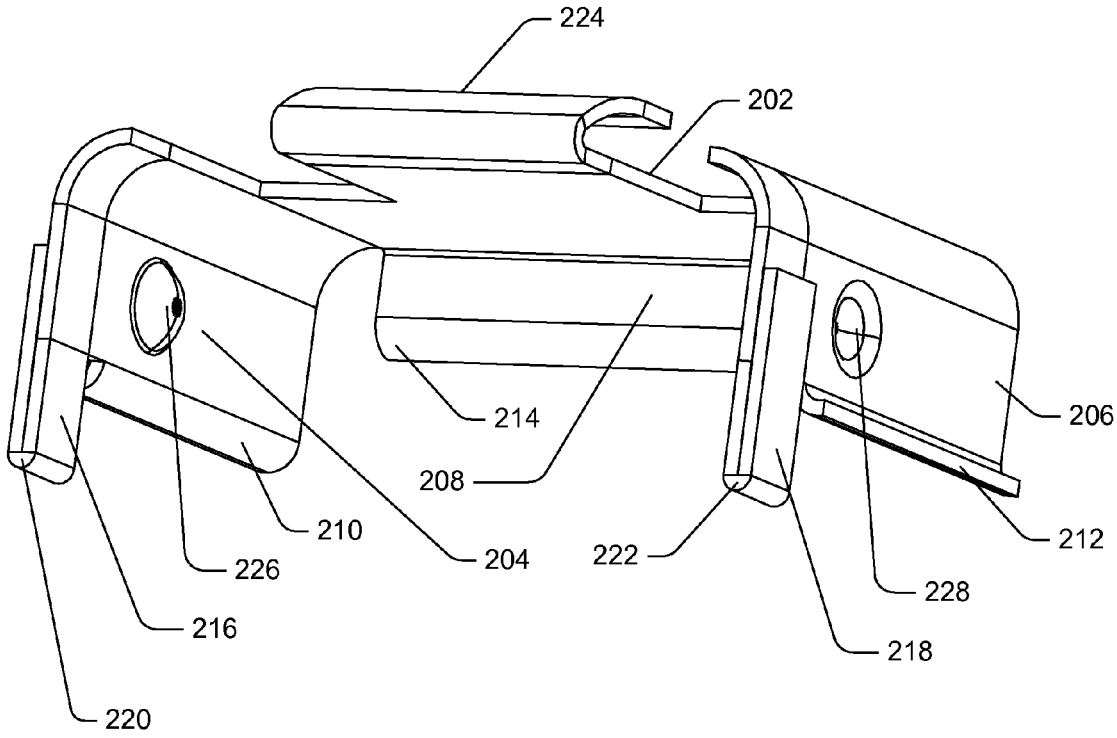
FIG. 2 shows a perspective illustration of the grounding clip shown in the MUSB grounding system of FIG. 1.

FIG. 2 shows a perspective illustration of the grounding clip 108 shown in the MUSB grounding system 100. A horizontal top surface 202 is attached to a vertical left surface 204, a vertical right surface 206, and a vertical back surface 208. The vertical surfaces 204, 206, and 208 may have curves 210, 212, and 214, respectively, or a roll at the bottom to ease insertion, minimize sharp edges, add structural rigidity, or any combination thereof.

A first locating feature 216 in the same plane as vertical left surface 204 extends downwards below the vertical left surface 204 beyond curved edge 210. A second locating feature 218 in the same plane as vertical right surface 206 extends downwards below the vertical right surface 206 beyond curved edge 212. The locating features aid in assembly by providing a positive alignment with the circuit board to which the receptacle is affixed. In other embodiments locating features 216 and 218 may also have a curve or roll 220 and 222, respectively, at the bottom to ease insertion, minimize cutting, add structural rigidity, and so forth. Locating features may also be present at other locations on the clip, such as extending from the back vertical surface 208.

On the horizontal top surface 202 a spring tab 224 is shown which originates from the front of the horizontal top surface 202 and extends generally towards the back surface 208 of the clip 108. The spring tab 224 may also originate at the back of the horizontal top surface 202 and extend forwards, or originate from one or more of the vertical surfaces 204 or 206 or 208.

On the vertical left surface 204 a first dimple 226 protrudes inward, towards the opposite vertical right surface 206. The first dimple 226 is shaped to positively engage the hole 106 or detent in the receptacle 104. Alternatively, the receptacle 104 may have a dimple to engage a corresponding hole or detent in the clip.

On the vertical right surface 206, a second dimple 228 protrudes inward, towards the opposite vertical left surface 204. The second dimple 228 is shaped to positively engage the hole 106 or detent in the receptacle 104. Alternatively, the receptacle 104 may have a dimple to engage a corresponding hole or detent in the clip. Interference features 226 and 228 are shown as hemispherical dimples. However, other interference structures capable of producing a positive engagement are possible such as, for example, bumps, ribs, ridges, lips, slots, tracks, opposing angled surfaces, crimps, and so forth. Instead of, or in addition to, an interference structure, a threaded fastener, rivet, weld, adhesive, and/or solder may be used to engage the clip to the receptacle.

Figure 3:
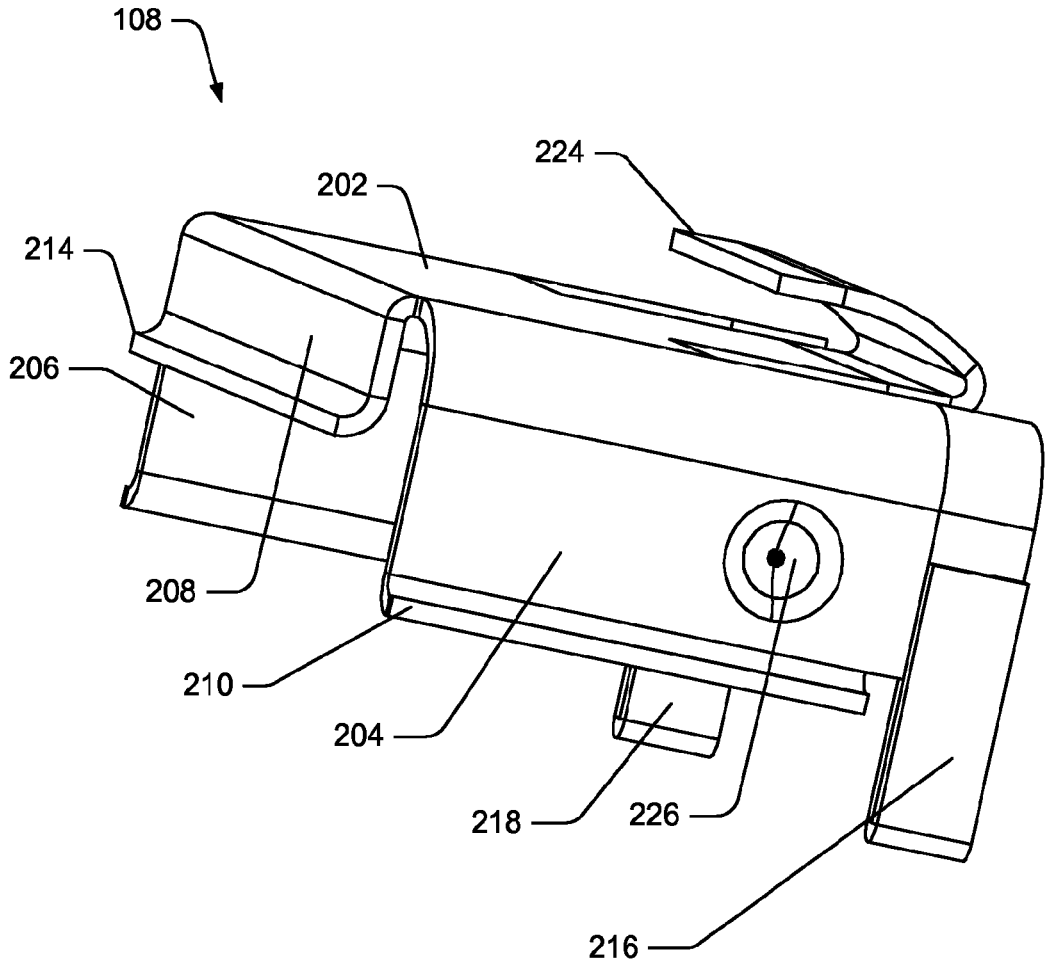
FIG. 3 shows the illustrative MUSB grounding clip from FIG. 1 from another perspective.

FIG. 3 shows the illustrative MUSB grounding clip 108 from another perspective. The back surface 208 with curve 214 is clearly shown, as is vertical right side 204, first dimple 226 and first locating feature 216.

Figure 4:
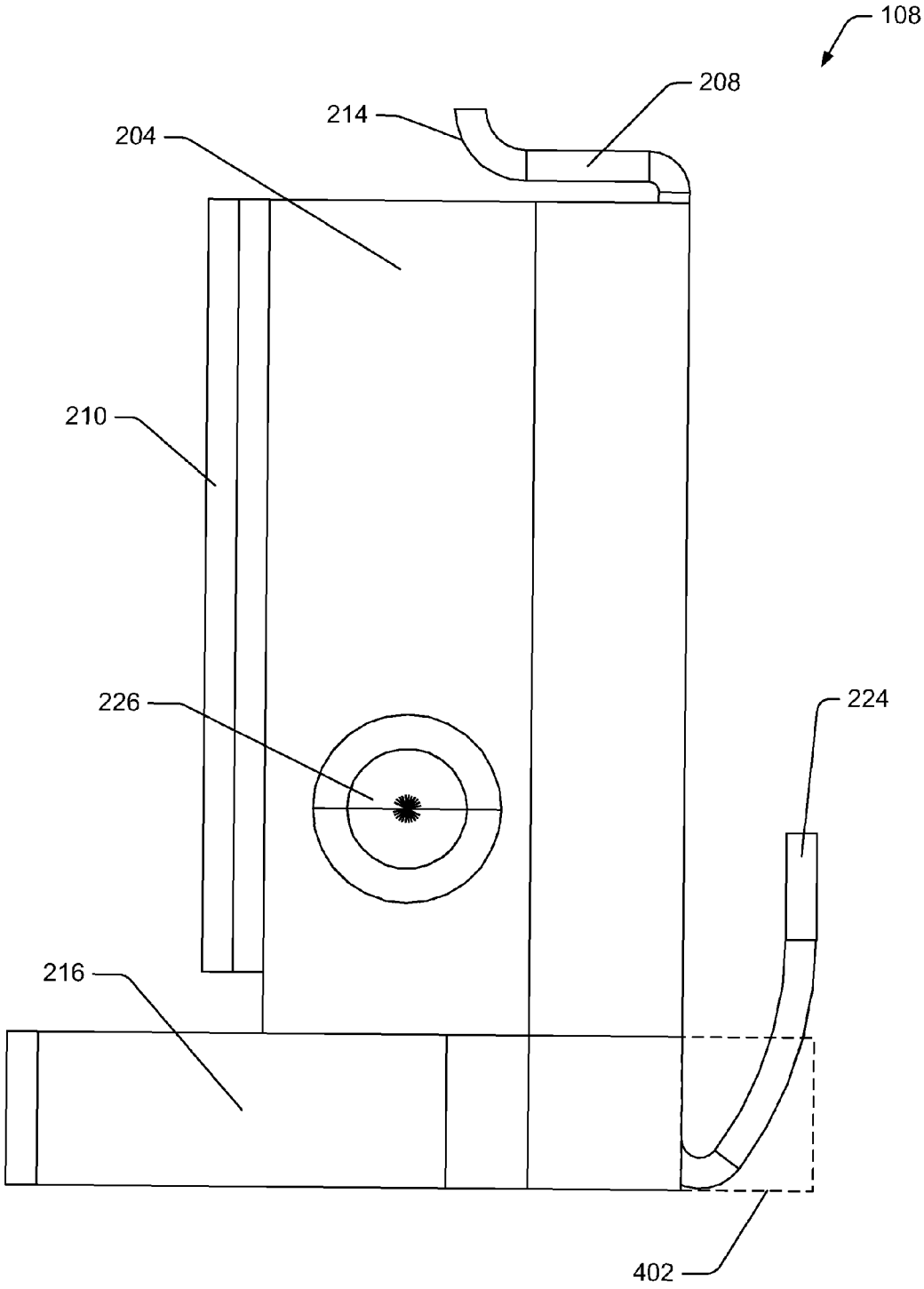
FIG. 4 is a left side view of the illustrative MUSB grounding clip of FIG. 1.
Figure 5:
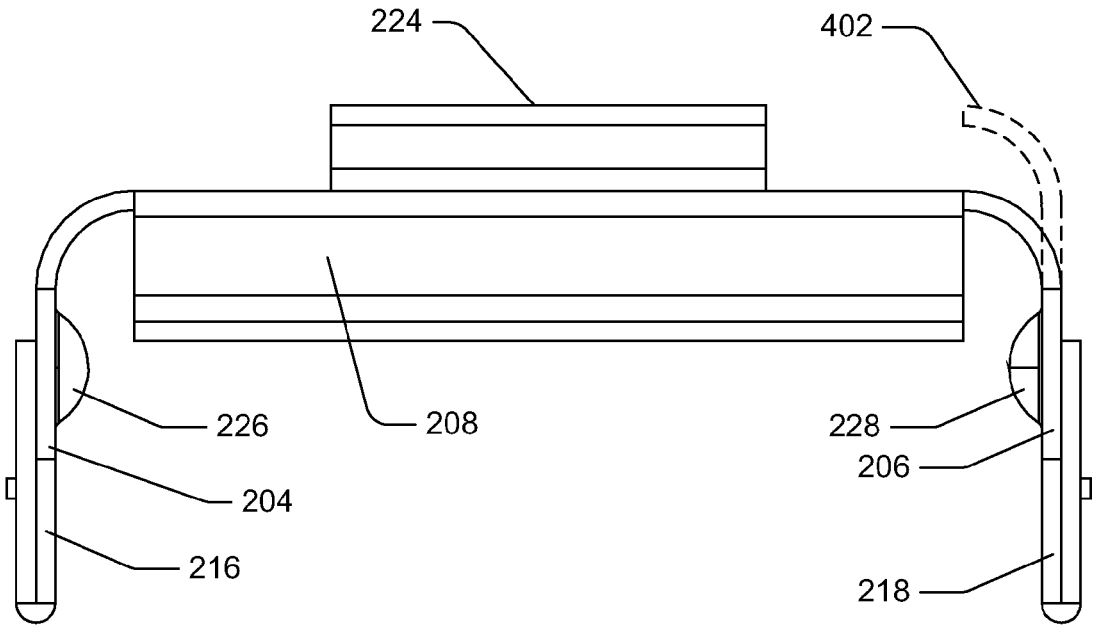
FIG. 5 is a front view of the illustrative MUSB grounding clip of FIG. 1.

FIG. 4 is a left side view of the illustrative MUSB grounding clip of FIG. 1, and FIG. 5 is a front view of the illustrative MUSB grounding clip of FIG. 1. FIGS. 4 and 5 shown an alternative configuration for the spring tab on a vertical surface. As shown in these figures, a spring tab 402 may originate from a vertical surface, such as the vertical right surface 206, and extend generally towards the opposite side of the clip 108.

Grounding Clip with No Back

Figure 6:
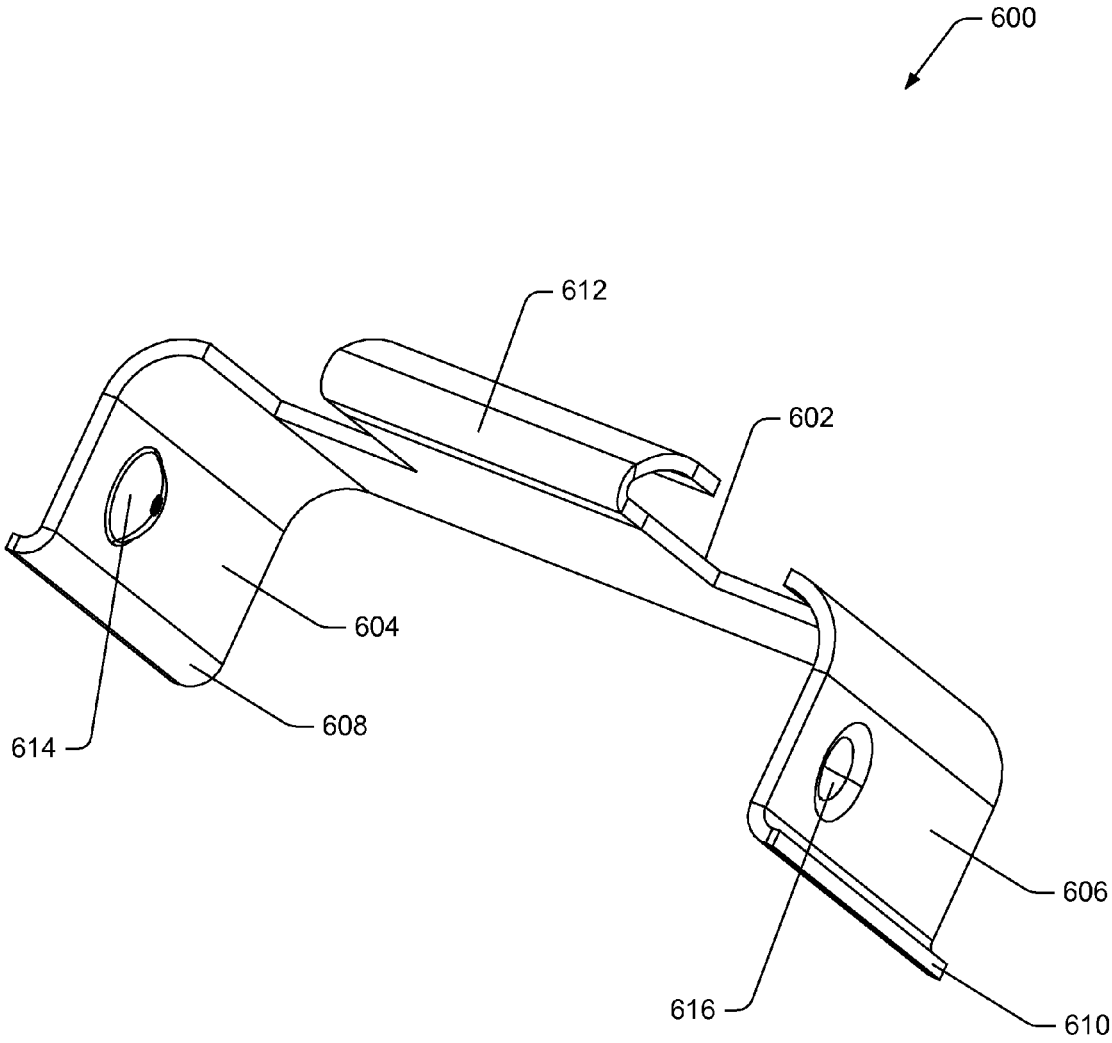
FIG. 6 shows another illustrative implementation of an MUSB grounding clip.

FIG. 6 shows an illustration of an alternate implementation of a MUSB grounding clip 600. A horizontal top surface 602 is attached to a vertical left surface 604 and a vertical right surface 606. The left and right vertical surfaces 604 and 606 may have curves 608 and 610, respectively, or a roll at the bottom to ease insertion, minimize cutting, add structural rigidity, or any combination thereof.

On the horizontal top surface 602, a spring tab 612 is shown, which originates from the front of the horizontal top surface 602 and extends generally towards the back of the clip 600. The spring tab 612 may also originate at the back of the horizontal top surface 602 and extend forwards, or originate from one or both of the left and right vertical surfaces 604 or 606.

On the vertical left surface 604 a first dimple 614 protrudes inward, towards the opposite vertical right surface 606. The first dimple 614 is shaped to positively engage the hole 106 or detent in the receptacle 104. Alternatively, the receptacle 104 may have a dimple to engage a corresponding hole or detent in the clip.

On the vertical right surface 606, a dimple 616 protrudes inward, towards the opposite vertical left surface 604. The dimple 616 is shaped to positively engage the hole 106 or detent in the receptacle 104. Alternatively, the receptacle 104 may have a dimple to engage a corresponding hole or detent in the clip.

While the detailed descriptions given above refer to a MUSB receptacle, the disclosed clips may be used with other form factors of USB such as Standard and Mini, as well as other types of electrical receptacles which require a ground connection.

The above-described clip is shown as being separate from the receptacle. However, the features of this clip may be integrated into the receptacle itself. For example, the spring tab may be integral to the top surface of the receptacle.

Any of the above-described clips may include cutouts or holes. These cutouts may be used to alter the stiffness or mass of the clip as desired. For example, placement of relief holes on the vertical sides and/or the top surface may reduce the force necessary to engage the clip to the receptacle.

The grounding clip may be comprised of material including metal (for example, beryllium copper, gold plated beryllium copper, aluminum, nickel silver, etc.), non-conducting polymer (for example, polyvinyl chloride, poly(tetrafluoroethene), etc.), conducting polymer (for example, polyaniline, poly(3-alkylthiophenes, etc.), or combinations thereof. Where the material is non-conductive, it may be plated with a conductive material. The clip may be made by stamping, milling, molding, forming, or other methods of fabrication suitable to the material chosen.

CONCLUSION

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims. Moreover, any of the features of any of the devices described herein may be implemented in a variety of materials or similar configurations.

What is claimed is:

1. A clip for grounding a micro universal serial bus (MUSB) receptacle to a grounding surface, the clip comprising:

a grounding clip body having a front side and a rear side opposite the front side, the body comprising a metal and having a horizontal top, a vertical left side, a vertical right side, and a vertical back;

a first locating feature extending downward from a front edge of the vertical left side;

a second locating feature extending downward from a front edge of the vertical right side;

a spring tab on the horizontal top extending away from the body and configured to contact a ground plane;

a first dimple on the vertical left side of the body, the dimple protruding inwards to engage a matching hole or detent in the receptacle; and a second dimple on the vertical right side of the body, the dimple protruding inwards to engage a matching hole or detent in the receptacle.

2. The clip of claim 1, wherein dimensions of at least one of the four sides is compatible with automated assembly line placement equipment.

3. The clip of claim 1, wherein the metal comprises a beryllium copper alloy.

4. The clip of claim 1, wherein the metal further comprises a gold plating.

5. A device comprising:

a grounding clip body having a front side and a rear side opposite the front side, the body comprising a metal and having a horizontal top, a vertical left side, a vertical right side, and a vertical back;

a first locating feature extending downward from a front edge of the vertical left side;

a second locating feature extending downward from a front edge of the vertical right side;

a spring tab on the horizontal top extending away from the body and configured to contact a ground plane;

a first dimple on the vertical left side of the body, the dimple protruding inwards to engage a matching hole or detent in a receptacle; and a second dimple on the vertical right side of the body, the dimple protruding inwards to engage a matching hole or detent in the receptacle.

6. The device of claim 5, wherein dimensions of at least one of the four sides is compatible with automated assembly line placement equipment.

7. The device of claim 5, wherein the metal comprises a beryllium copper alloy.

8. The device of claim 5, wherein the metal further comprises a gold plating.

9. The device of claim 5, wherein horizontal edges of the vertical left and right surfaces are curved or rolled.

10. The device of claim 5, wherein the receptacle is configured to accept a micro Universal Serial Bus plug.

11. A device comprising:

a grounding clip body having a front side and a rear side opposite the front side, the body comprising a metal and having a horizontal top, a vertical left side, a vertical right side, and a vertical back;

a first locating feature extending downward from a front edge of the vertical left side;

a second locating feature extending downward from a front edge of the vertical right side;

a spring tab on the horizontal top extending away from the body and configured to contact a ground plane;

a first engagement feature on the vertical left side of the body, the engagement feature configured to engage a matching feature in a receptacle; and a second engagement feature on the vertical right side of the body, the engagement feature configured to engage a matching feature in the receptacle.

12. The device of claim 11, wherein dimensions of at least one of the four sides is compatible with automated assembly line placement equipment.

13. The device of claim 11, wherein the metal comprises a beryllium copper alloy.

14. The device of claim 11, wherein the metal further comprises a gold plating.

15. The device of claim 11, wherein horizontal edges of the vertical left and right surfaces are curved or rolled.

16. The device of claim 11, wherein the receptacle is configured to accept a micro Universal Serial Bus plug.

* * * * *